US008127835B2

(12) United States Patent
Dowling et al.

(10) Patent No.: US 8,127,835 B2
(45) Date of Patent: Mar. 6, 2012

(54) INTEGRATED CABLE HANGER PICK-UP SYSTEM

(75) Inventors: Michael A. Dowling, Houston, TX (US); Jason Kamphaus, Missouri City, TX (US); Harryson Sukianto, Missouri City, TX (US); Alain P. Dorel, Houston, TX (US); Joseph Varkey, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 294 days.

(21) Appl. No.: 12/388,323

(22) Filed: Feb. 18, 2009

(65) Prior Publication Data

US 2010/0206544 A1 Aug. 19, 2010

(51) Int. Cl.

| | |
|---|---|
| ***E21B 23/00*** | (2006.01) |
| ***E21B 21/00*** | (2006.01) |
| ***E21B 41/00*** | (2006.01) |
| ***E21B 43/00*** | (2006.01) |

(52) U.S. Cl. ..... 166/75.11; 166/377; 166/378; 166/244.1

(58) Field of Classification Search ..... 166/377, 166/378, 244.1, 254.1, 254.2; 294/86.1, 294/86.17; 285/145.3, 145.4
See application file for complete search history.

(56) References Cited

U.S. PATENT DOCUMENTS

| | | | |
|---|---|---|---|
| 2,708,411 | A | 5/1955 | Richardson |
| 2,834,300 | A | 5/1955 | Brock |
| 2,941,629 | A | 6/1960 | Rohacs |
| 3,183,972 | A | 5/1965 | Fredd |
| 3,589,838 | A | 6/1971 | Tuzson |
| 3,912,009 | A | 10/1975 | Davis, Jr. |
| 4,043,390 | A | 8/1977 | Glotin |
| 4,184,515 | A | 1/1980 | Streich et al. |
| 4,317,485 | A | 3/1982 | Ross |
| 4,598,630 | A | 7/1986 | Kao |
| 4,688,999 | A | 8/1987 | Ames et al. |
| 5,188,517 | A | 2/1993 | Koster |
| 5,203,172 | A | 4/1993 | Simpson et al. |
| 5,229,017 | A | 7/1993 | Nimerick et al. |
| 5,577,890 | A | 11/1996 | Nielsen et al. |
| 5,778,978 | A | 7/1998 | Crow |
| 5,871,051 | A | 2/1999 | Mann |

(Continued)

FOREIGN PATENT DOCUMENTS

GB 2099043 A 12/1982

(Continued)

OTHER PUBLICATIONS

Dowling, Michael A. et al, "Overpressure Protection in Gas Well Dewatering Systems", U.S. Appl. No. 12/372,962, filed Feb. 18, 2009.

(Continued)

*Primary Examiner* — Thomas Beach
*Assistant Examiner* — James Sayre
(74) *Attorney, Agent, or Firm* — Jim Patterson

(57) ABSTRACT

A hanger system is provided for supporting a cable-supported dewatering pump in a gas well. A dewatering pump is supported in a downhole location by a cable. A cable hanger bears the weight of the cable and the weight of the dewatering pump. A pulling tool is configured to detachably connect to the cable hanger and to support the weight of the cable hanger, cable and gas well dewatering system as it is pulled out of a seated position in the well.

20 Claims, 9 Drawing Sheets

U.S. PATENT DOCUMENTS

| | | | | |
|---|---|---|---|---|
| 5,961,841 | A | 10/1999 | Bowers | |
| 6,000,468 | A | 12/1999 | Pringle | |
| 6,017,198 | A | 1/2000 | Traylor et al. | |
| 6,044,909 | A | 4/2000 | Gano | |
| 6,069,118 | A | 5/2000 | Hinkel et al. | |
| 6,089,322 | A | 7/2000 | Kelley et al. | |
| 6,140,277 | A | 10/2000 | Tibbles et al. | |
| 6,140,817 | A | 10/2000 | Flaum et al. | |
| 6,196,309 | B1 | 3/2001 | Estilette, Sr. | |
| 6,508,310 | B1 | 1/2003 | Mioduszewski et al. | |
| 6,569,814 | B1 | 5/2003 | Brady et al. | |
| 6,638,896 | B1 | 10/2003 | Tibbles et al. | |
| 6,660,693 | B2 | 12/2003 | Miller et al. | |
| 6,720,290 | B2 | 4/2004 | England et al. | |
| 6,837,309 | B2 | 1/2005 | Boney et al. | |
| 6,854,515 | B2 | 2/2005 | Matthews et al. | |
| 6,915,854 | B2 | 7/2005 | England et al. | |
| 6,964,299 | B2 | 11/2005 | Scarsdale | |
| 7,005,765 | B1 | 2/2006 | Schulz et al. | |
| 7,124,819 | B2 | 10/2006 | Ciglenec et al. | |
| 7,150,325 | B2 * | 12/2006 | Ireland et al. | 166/366 |
| 7,380,608 | B2 | 6/2008 | Geier | |
| 7,726,404 | B2 | 6/2010 | Kubala et al. | |
| 2002/0108757 | A1 * | 8/2002 | Traylor | 166/384 |
| 2004/0060705 | A1 | 4/2004 | Kelley | |
| 2004/0084178 | A1 | 5/2004 | Reid | |
| 2006/0083645 | A1 | 4/2006 | Simmons | |
| 2007/0023191 | A1 | 2/2007 | Dreggevik | |
| 2007/0110597 | A1 | 5/2007 | Traylor et al. | |
| 2007/0227732 | A1 | 10/2007 | Miller et al. | |
| 2007/0251704 | A1 | 11/2007 | Reimert et al. | |
| 2009/0217992 | A1 | 9/2009 | Wilson | |
| 2010/0096129 | A1 | 4/2010 | Hinkel et al. | |
| 2010/0206544 | A1 | 8/2010 | Dowling et al. | |
| 2010/0206549 | A1 | 8/2010 | Dowling et al. | |
| 2010/0206568 | A1 | 8/2010 | Dowling et al. | |
| 2010/0209265 | A1 | 8/2010 | Dowling et al. | |
| 2010/0211226 | A1 | 8/2010 | Dowling et al. | |

FOREIGN PATENT DOCUMENTS

| | | | |
|---|---|---|---|
| GB | 2339914 | A | 2/2000 |
| GB | 2436576 | A | 10/2007 |
| GB | 2457784 | A | 9/2009 |
| WO | 2010096303 | A1 | 8/2010 |
| WO | 2010096431 | A1 | 8/2010 |
| WO | 2010096481 | A1 | 8/2010 |

OTHER PUBLICATIONS

Dowling, Michael A. et al, "Gas Well Dewatering System", U.S. Appl. No. 12/388,098, filed Feb. 18, 2009.

Dowling, Michael A. et al, "Devices, Systems, and Methods for Equalizing Pressure in a Gas Well", U.S. Appl. No. 12/388,211, filed Feb. 18, 2009.

Dowling, Michael A. et al, "Monitoring and Control System for a Gas Well Dewatering Pump", U.S. Appl. No. 12/388,542, filed Feb. 18, 2009.

* cited by examiner

INTEGRATED CABLE HANGER PICK-UP SYSTEM

FIELD

The present application relates generally to gas well dewatering systems. More particularly, the present application relates to hanger systems for supporting a cable-supported dewatering pump in a gas well.

BACKGROUND

Hydrocarbons and other fluids are often contained within subterranean formations at elevated pressures. Wells drilled into these formations allow the elevated pressure within the formation to force the fluids to the surface. However, in low pressure formations, or when formation pressure has diminished, the formation pressure may be insufficient to force fluids to the surface. In these cases, a positive displacement pump, such as a piston pump, can be installed to provide the required pressure to produce the fluids.

The function of pumping systems in gas wells is to produce liquid, generally water, that enters the well bore naturally with the gas. This is generally necessary only on low flow rate gas wells. In high flow rate gas wells, the velocity of the gas tends to be sufficient enough that it carries the water to the surface. In low flow rate wells, the water accumulates in the well bore and restricts the flow of gas. By pumping out the water, the pump allows the well to flow at a higher gas rate, and this additional produced gas, which eventually is related to additional revenue, and helps pay for the pumping unit.

SUMMARY

According to an embodiment, it is herein disclosed to use a cable that is capable of holding its own weight, plus the weight of dewatering pump equipment deployed at depths in excess of 10,000 feet. The cable can be configured to conduct electricity required to power the pumping system. In addition, the cable can also be used to retrieve the pumping system via for example a winch located at the surface of the well.

Once the pump is landed downhole, the supporting cable must be landed at the surface via a permanent weight-supporting device or cable hanger. The cable hanger can include primary and secondary means of support such as a friction clamp system in combination with a rope socket system, back-up clamp, and/or the like.

The present disclosure recognizes that it is necessary to provide a system for picking up the cable hanger (primary, secondary or otherwise) so that the downhole pumping system can be pulled from the well when it no longer functions properly. It is desirable to provide such a pickup system that is simple, fast, strong and extremely reliable, as a failure may result in injury or death. The pickup system can be applied to the primary weight-holding device or hanger, or to a secondary or later such device. Preferably, it is applied to the last weight-bearing device installed (i.e. the first picked up).

In one example, the hanger system includes a dewatering pump supported in a downhole location by a cable, a cable hanger bearing the weight of the cable and the weight of the dewatering pump, and a pulling tool configured to detachably connect to the cable hanger and support the weight of the cable hanger, cable and gas well dewatering system as it is pulled out of a seated position in the well.

In another example, the pulling tool includes a bearing sleeve and a locking sleeve, wherein one of the bearing sleeve and locking sleeve is slidable axially relative to the other to selectively cause a ball bearing to engage with and bear on surfaces of the cable hanger and the pulling tool to thereby connect the pulling tool to the cable hanger in a manner that the pulling tool can support the weight of the cable hanger, cable, and dewatering pump.

In another example, the pulling tool includes a pulling sleeve and locking sleeve, wherein one of the pulling sleeve and locking sleeve are slidable axially relative to the other against a bias to selectively cause a collet finger to bear on a surface of the cable hanger and thereby connect the pulling tool to the cable hanger in a manner that the pulling tool can support the weight of the cable hanger, cable and dewatering pump.

In another example, the pulling tool includes a sleeve having internal threads configured to couple with threads on the cable hanger and a flange surface for engaging with a bearing surface located inside of the sleeve.

In another example, the pulling tool is connected to the hanger by a J-slot connection.

BRIEF DESCRIPTION OF THE DRAWINGS

The best mode is described hereinbelow with reference to the following drawing figures.

DETAILED DESCRIPTION OF THE DRAWINGS

In the following description, certain terms have been used for brevity, clearness and understanding. No unnecessary limitations are to be implied therefrom beyond the requirement of the prior art because such terms are used for descriptive purposes only and are intended to be broadly construed. The different systems described herein may be used alone or in combination with other systems. It is to be expected that various equivalents, alternatives, and modifications are possible within the scope of the appended claims.

Figure 1:
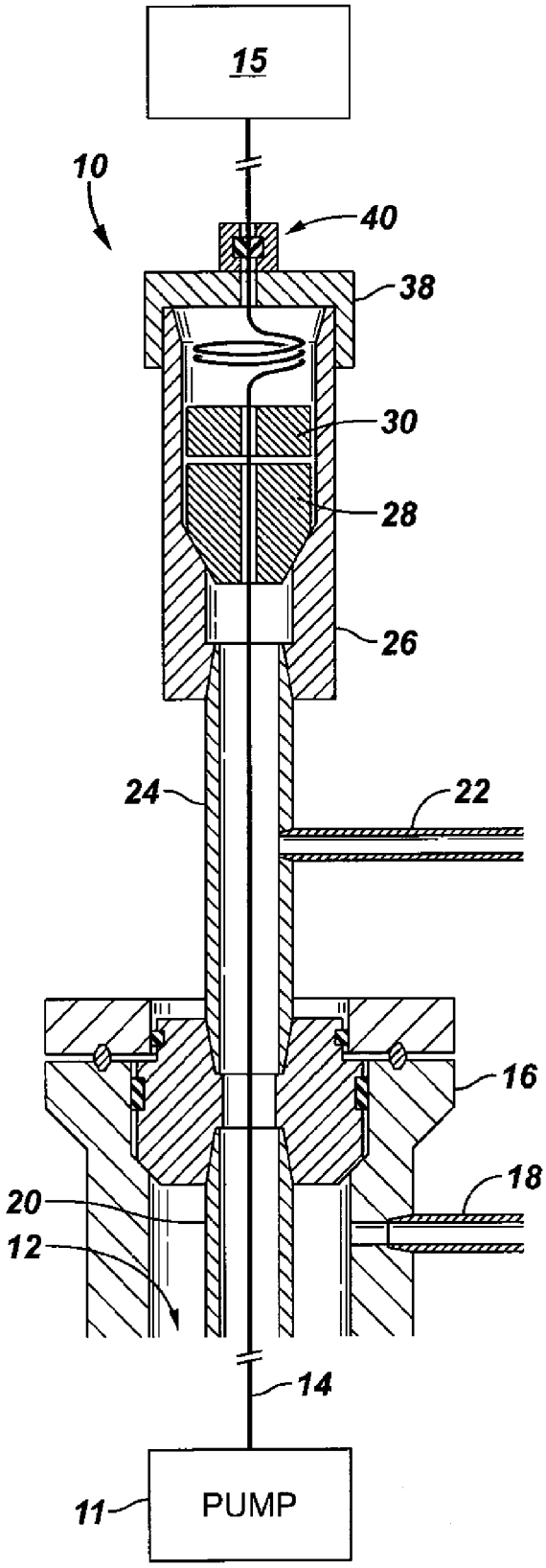
FIG. 1 is a schematic view of an exemplary cable hanger system.

FIG. 1 depicts a cable hanger system 10 for supporting a cable-supported dewatering pump (shown schematically at 11) in a gas well 12. A cable 14 extends downhole and is utilized to deploy the dewatering pump (shown schematically at 11) up to deployment depths in excess of 10,000 feet. The cable 14 is uniquely configured to support the weight of the dewatering pump 11 and related equipment and further to conduct electricity required to power the pumping system. The cable 14 is also configured for use as a retrieval mechanism for the dewatering pump 11. The cable 14 can further be used to communicate with a downhole monitoring system (not shown) which can transmit such data as downhole pressure, downhole temperature, if the fluid level is above or below the pump, pump vibration, electrical installation integrity, etc. Using a single cable 14 to install and power the system allows installation of the pump 11 without pulling the production tubing and without any coiled tubing unit. This facilitates tool installation without a complex rig. Rather, deployment can be facilitated by a truck with a winch (shown schematically at 15) that lowers the dewatering pump 11 on the cable 14. This allows the system to operate at well sites that are remote or difficult to access with a large rig.

The cable hanger system 10 depicted in FIG. 1 includes generally a casing head 16 containing an outlet 18 for produced gas and the upper portion of production tubing 20 which extends downhole into the gas well 12. An outlet 22 extends from a pup joint 24 and conveys water produced by the dewatering pump 11 located in a downhole location in the gas well 12. A cable head 26 is coupled to the pup joint 24 and includes primary and secondary cable hangers 28, 30. Although the example shown in FIG. 1 includes primary and secondary cable hangers 28, 30, it should be recognized that the cable head 26 could be equipped with a single cable hanger or more than two cable hangers depending upon the specific needs of the system 10.

Figure 2:
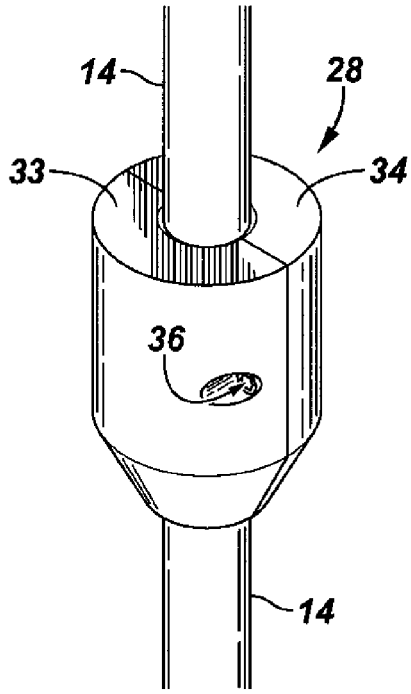
FIG. 2 depicts a split-piece cable hanger.

In the example shown in FIGS. 1 and 2, the primary cable hanger 28 is a friction clamp that is installed on the cable 14 while under tension. The friction clamp 28 shown in the example includes two sections 33, 34 that are connected together by for example a bolt connection 36 to at least temporarily support the weight of the cable 14 and attached dewatering pump by a friction force. The secondary cable hanger 30 is beneficial because it has been found that over time, the friction stress of the primary cable hanger 28 will likely relax. One advantage of providing secondary or tertiary systems is that while the primary cable hanger 28 holds the weight of the cable 14 and dewatering pump, the secondary and potentially tertiary cable hangers can be installed on sections of the cable 14 that are no longer under tension. This allows for manipulation of the cable 14 or its associated weight-bearing armor to make more durable supports. In the example shown, the secondary cable hanger 30 can utilize for example a rope socket which splays external and internal armor layers in the cable 14 and inserts nuts between the layers. After capture, this type of support system is stronger than the cable 14 itself.

After the cable is landed in the primary and secondary cable hangers 28, 30, the cable 14 can be cut and a cable head cap 38 and associated seal 40 installed to seal around and protect the cable 14. The cable 14 passes through the seal 40 for connection to an applicable surface power control system (not shown).

FIGS. 3-11 illustrate various means for picking up the cable hanger(s) to allow for retrieval of the cable 14 and associated dewatering pump 11 in case the system 10 no longer operates properly. The devices illustrated in FIGS. 3-11 can be part of the primary weight-holding device (i.e. primary cable hanger 28) or on a secondary (i.e. secondary cable hanger 30) or later device. The devices shown in FIGS. 3-11 have been found to work easiest on the last weight-bearing device installed (i.e. the first picked up); however, the concepts claimed herein are not so limited.

Figure 3:
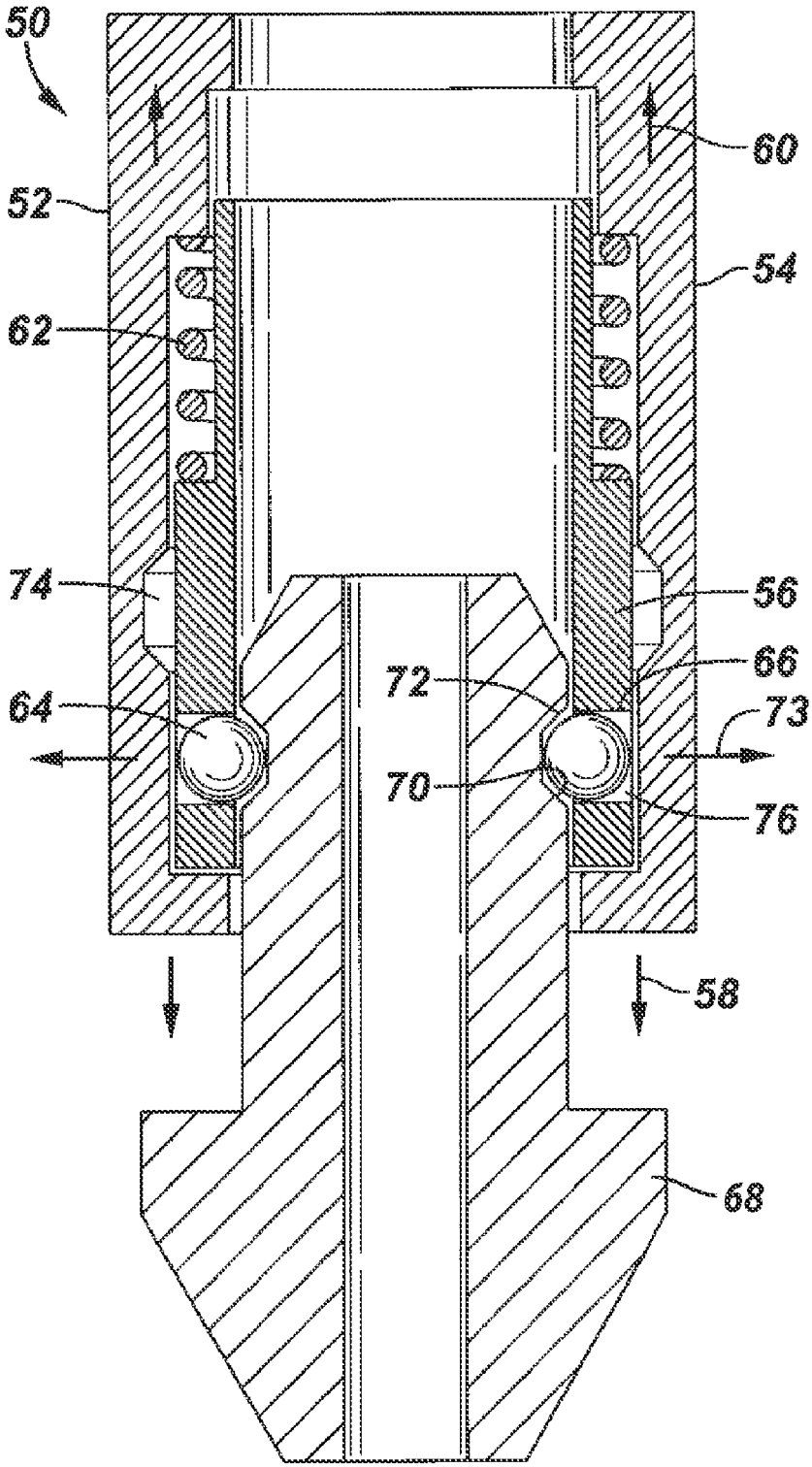
FIG. 3 is a schematic view of a push-lock ball bearing connection for connecting a pulling tool to a cable hanger.

FIG. 3 depicts a ball bearing quick connect system 50. A pulling tool 52 includes a bearing sleeve 54 and a locking sleeve 56. The bearing sleeve 54 is slidable axially (arrow 58) against a bias provided by spring 62 to selectively cause a ball bearing 64 to engage with and bear on a surface of the cable hanger 68 and a surface of the locking sleeve 56 to thereby allow the pulling tool 52 to support the cable hanger 68 when lifted upward in the direction of arrow 60. The ball bearing 64 resides in a cone-shaped aperture 70 in the outer surface of the cable hanger 68.

In use, FIG. 3 shows the bearing sleeve 54 in a first position wherein the ball bearing 64 bears on the surface 66 of the locking sleeve 56 and a surface 72 in the cone-shaped aperture 70 of the cable hanger 68. As the bearing sleeve 54 slides axially downward in the direction of arrow 58, a recess 74 in the bearing sleeve 54 aligns with an aperture 76 in the locking sleeve 56 to allow the ball bearing 64 to roll out of the aperture 70 in the direction of arrow 73, thereby allowing for disengagement of the pulling tool 52 and cable hanger 68. To reinstall the pulling tool 52, the pulling tool 52 is pushed down against the cable hanger 68. The position of the ball bearing 64 relative to the aperture 74 in the bearing sleeve 54 prevents the locking sleeve 56 from moving down. In this manner, the spring 62 is compressed against the bias in order to move the pulling tool 52 down. Once the bearing sleeve 54 has moved down to the point where the ball bearing 64 aligns with the aperture 74, the locking sleeve 56 is free to move down. Continuing to push the pulling tool 52 down, eventually the ball bearing 64 aligns with the aperture 70 on the cable hanger 68. The spring 62 forces this movement and at that point an operator can feel that the tool 52 has locked. Releasing the pulling tool 52, the spring 62 will push the bearing sleeve 54 back up in the direction of arrow 60.

Figure 4:
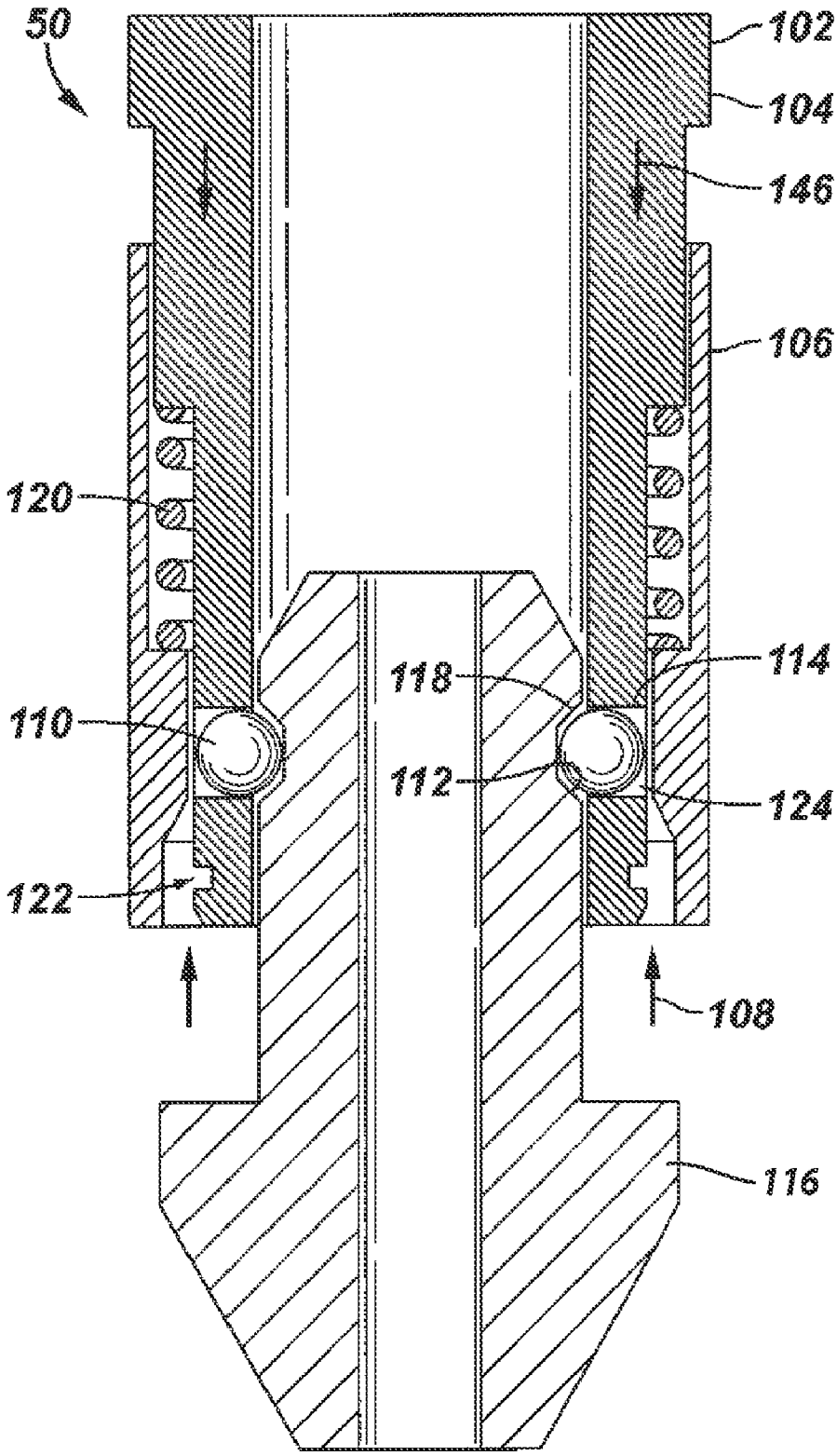
FIG. 4 is a schematic view of a pull-lock ball bearing connection for connecting a pulling tool to a cable hanger.

FIG. 4 depicts another example of a ball bearing quick connect system 50. A pulling tool 102 includes a bearing sleeve 104 and a locking sleeve 106. The locking sleeve 106 is slidable axially upward (arrow 108) relative to the bearing sleeve 104 to selectively cause a ball bearing 110 to engage with and bear on surfaces 112, 114 of the cable hanger 116 and bearing sleeve 104, respectively. The ball bearing 110 resides in an aperture 118 in the hanger 116. The locking sleeve 106 is slidable axially upward (arrow 108) relative to the bearing sleeve 104 against a bias provided by spring 120. FIG. 4 shows the locking sleeve 106 in a first position wherein the ball bearing 110 bears on the surfaces 112, 114 of the cable hanger 116 and locking sleeve 106, respectively. The locking sleeve 106 slides axially upward (arrow 108) into a second position wherein a recess 122 on the locking sleeve 106 is aligned with an aperture 124 in bearing sleeve 104 and thereby allows the ball bearing 110 to roll out of the cone-shaped aperture 118 in the hanger 116. This allows for disconnection of the pulling tool 102 from the hanger 116 in the direction of arrow 108.

To reconnect the pulling tool 102 to the hanger 116, the locking sleeve 106 is pushed upwardly (arrow 108) against the bias of spring 120 until the ball bearing 110 is allowed to move into the adjacent aperture 124 and recess 122. Thereafter, the pulling tool 102 is slid axially downward (arrow 146) onto the cable hanger 116 until the ball bearing 110 is allowed to roll into the aperture 118 in the cable hanger 116. Thereafter, the locking sleeve 106 is released and the bias of spring 120 forces the locking sleeve 106 downwardly (arrow 146) to force the ball bearing 110 to bear on the surfaces 112, 114.

Figure 5:
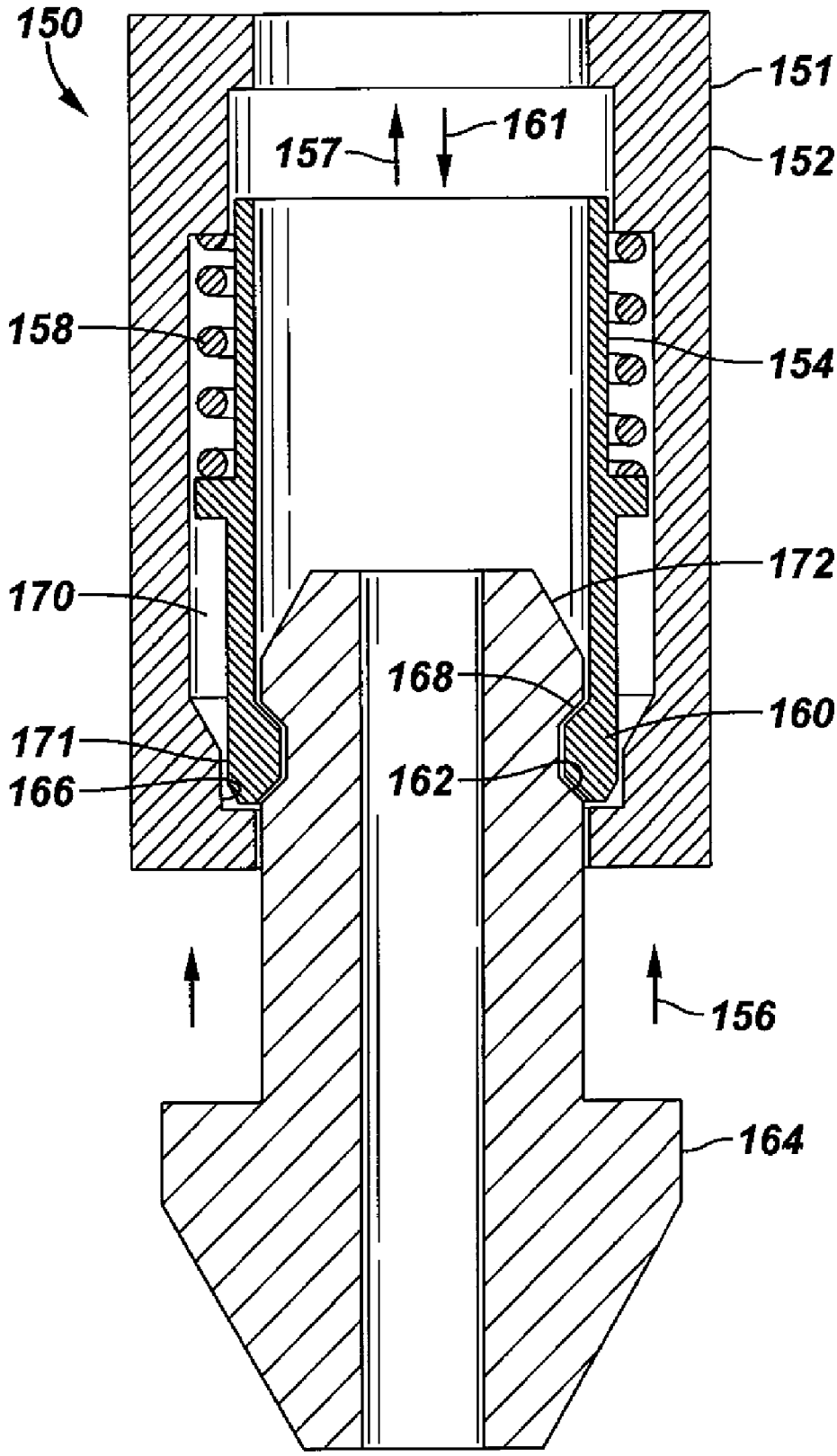
FIG. 5 is a schematic view of a push-lock collet connection for connecting a pulling tool to a cable hanger.

FIG. 5 depicts a collet quick connect system 150. The system 150 includes a pulling sleeve 152 and a locking sleeve 154. The pulling sleeve 152 is slidable axially in the direction of arrow 156 with respect to the locking sleeve 154 against a bias provided by spring 158 to selectively cause a collet finger 160 on the locking sleeve 154 to bear on a surface 162 of cable hanger 164 to thereby connect the pulling tool 151 to the cable hanger 164.

In the example shown, the collet finger 160 is part of the locking sleeve 154 and the pulling sleeve 152 is axially slidable relative to the locking sleeve 154 from a first position shown in FIG. 5 wherein the collet finger 160 is sandwiched between the outer surface 162 of cable hanger 164 and an inner surface 166 of the pulling sleeve 152. The collet finger 160 can be cut into and a part of the locking sleeve 154. The surface 162 is part of a collet-shaped aperture 168 of the cable hanger 164, the collet-shaped aperture 168 being sized to receive the convex shape of the collet finger 160. Axially sliding the pulling sleeve 152 out of the first position into a second position locates a recess 170 formed in the pulling sleeve 152 adjacent the outer surface 171 of the collet finger 160. Thereafter, the entire pulling tool 151 can be pulled upward (arrow 157) away from the cable hanger 164 as the collet finger 160 is allowed to deflect towards recess 170 under moderate stress, out of the cone-shaped aperture 168, thus separating the pulling tool 151 from the cable hanger 164.

To reinstall the pulling tool 151 onto the cable hanger 164, the above steps are repeated in reverse order. The pulling sleeve 152 is slid axially downward (arrow 161) against the bias of spring 158 and the entire pulling tool 151 is slid axially downward (arrow 161) onto the cable hanger 164. The cam surface 172 on the cable hanger 164 applies moderate stress to the collet finger 160, thus causing the finger 160 to deflect radially outwardly as the tool 151 moves in the direction of arrow 161. As the collet finger 160 aligns with the aperture 168, its natural resiliency causes it to snap into place and engage with the aperture 168. Thereafter, the bias of spring 158 causes the pulling sleeve 152 to move axially upward in the direction of arrow 156 thus sandwiching the collet finger 160 between the surfaces 166, 170 and connecting the pulling tool 151 to the hanger 164.

Figure 6:
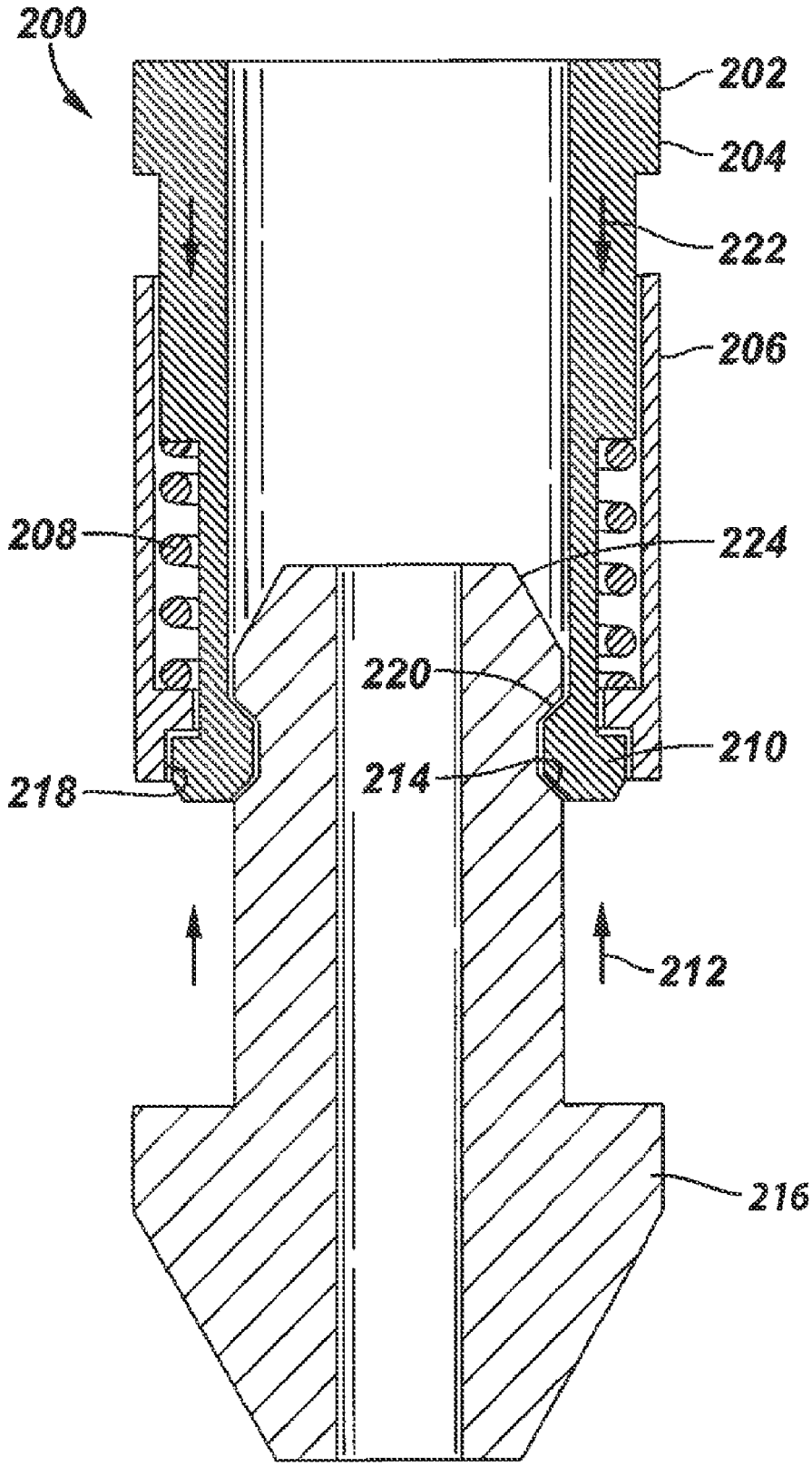
FIG. 6 is a schematic view of a pull-lock collet connection for connecting a pulling tool to a cable hanger.

FIG. 6 depicts another example of a collet quick connect system 200. A pulling tool 202 includes a pulling sleeve 204 and a locking sleeve 206 which are coupled together and biased apart by a spring 208. A collet finger 210 is formed on the pulling sleeve 204. The locking sleeve 206 is axially slidable in the direction of arrow 212 relative to the pulling sleeve 204 from a first position shown in FIG. 6 wherein the collet finger 210 is sandwiched between an outer surface 214 of the cable hanger 216 and an inner surface 218 of the locking sleeve 206 to a second position wherein the collet finger 210 is not sandwiched between the respective surfaces 214, 218 and free to bend outwardly out of the recess 220 formed in the outer surface of cable hanger 216, thus allowing for disconnect from the cable hanger 216.

To install the pulling tool 202 onto the cable hanger 216, the locking sleeve 206 is moved upward (arrow 212) against the bias of spring 208 and the entire tool 202 is forced downwardly in the direction of arrow 222. The collet finger 210 is cammed outwardly by camming surface 224 on cable hanger 216 and then its natural resiliency causes the collet finger 210 to snap into the recess 220. Thereafter, the locking sleeve 206 is moved downwardly in the direction of arrow 222 by the bias of spring 208 until the collet finger 210 is sandwiched between the surfaces 214, 218, thus connecting the pulling tool 202 to the hanger 216.

Figure 7:
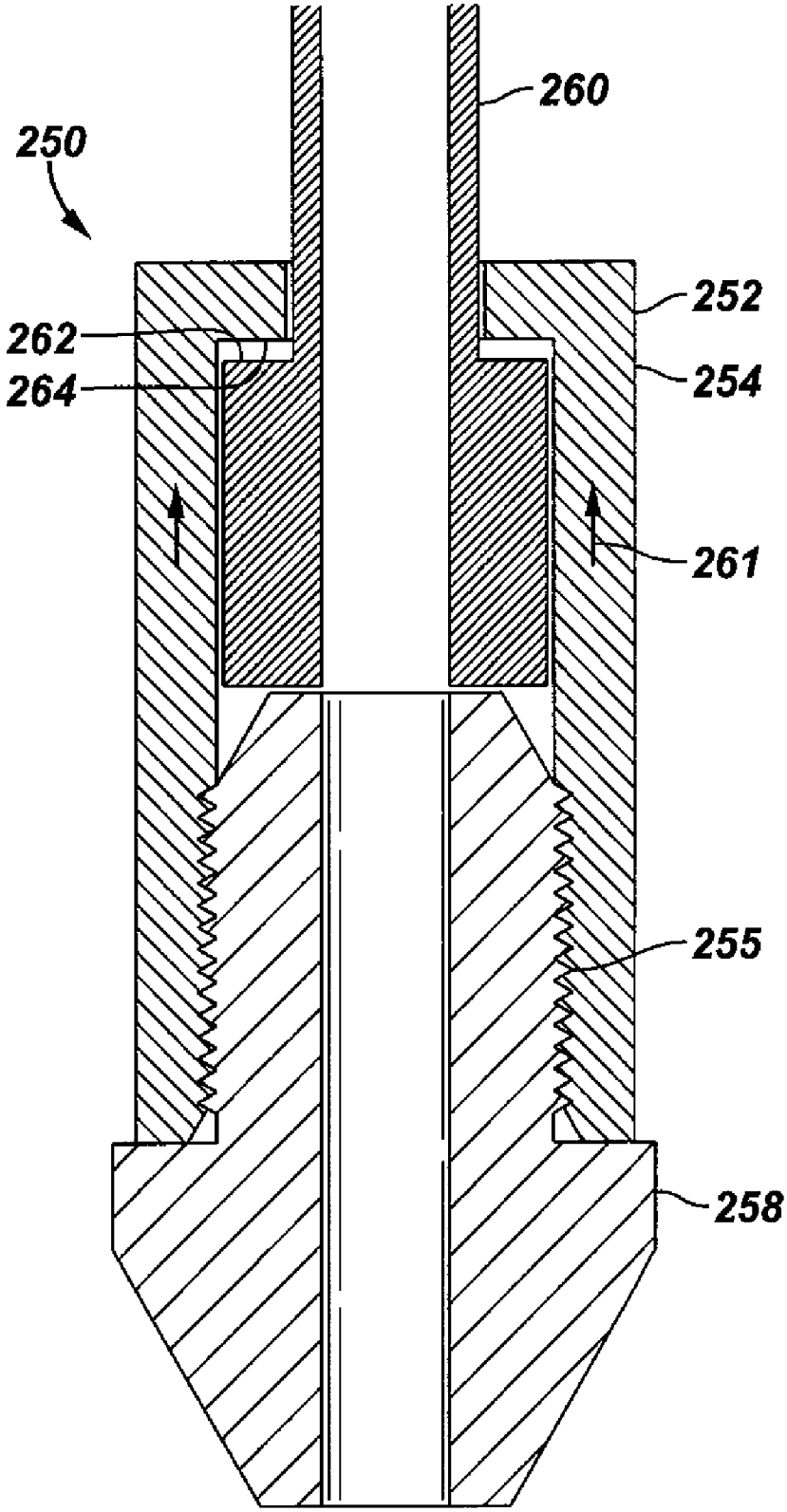
FIG. 7 is a schematic view of a threaded connection for connecting a pulling tool to a cable hanger.

FIG. 7 depicts a threaded quick connect system 250. The threaded quick connect system 250 includes a pulling tool 252 having a threaded sleeve 254 configured to couple with threads 255 on an outer surface of the cable hanger 258. A pulling device 260 includes an outer flange surface 262 configured to engage with an inner bearing surface 264 on sleeve 254. Upward force on pulling device 260 (arrow 261) causes flange surface 262 to bear on bearing surface 264, which thereby transfers the upward force to the threaded connection between the sleeve 254 and cable hanger 258.

Figure 8:
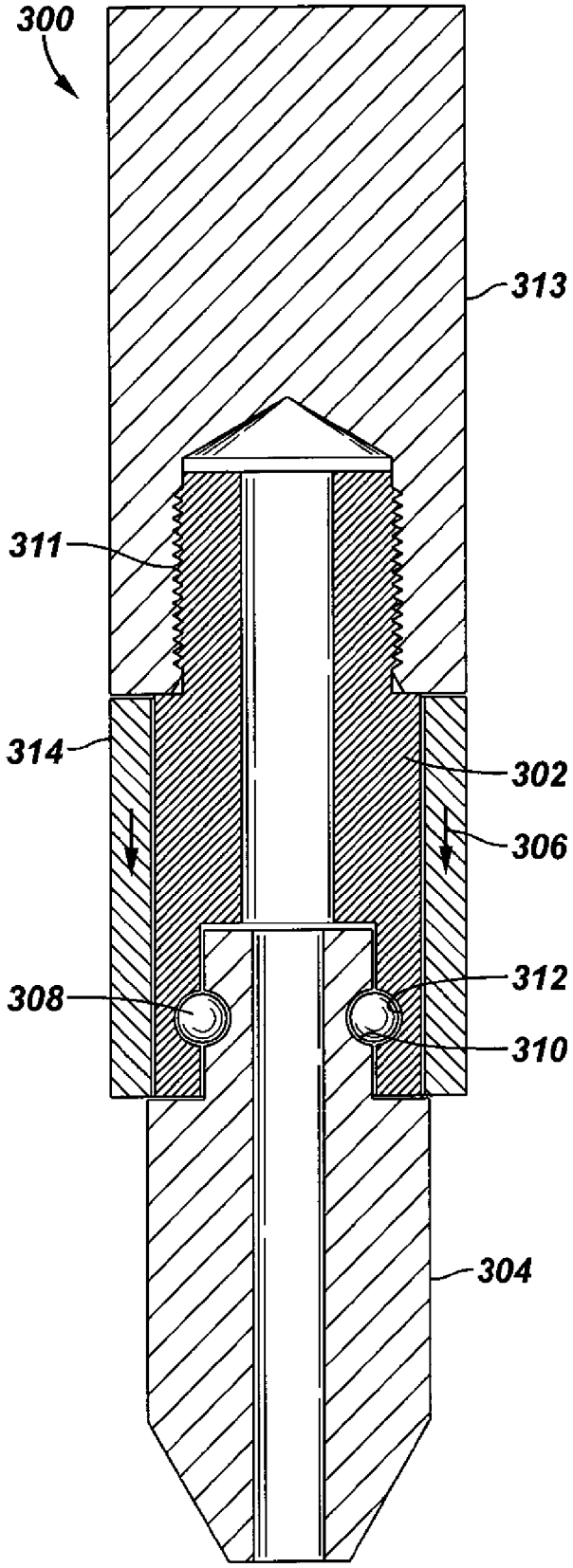
FIG. 8 is a schematic view of a tangential pin connection for connecting a pulling tool to a cable hanger.

FIG. 8 depicts a tangential pin connection system 300. A female connector sleeve 302 slides over the upper end of cable hanger 304 in the direction of arrow 306. Two or more tangential pins 308 are then inserted into aligned holes formed by adjacent grooves 310, 312 in the hanger 304 and connector sleeve 302, respectively. A cover sleeve 314 slides over the pins 308 in the direction of arrow 306 to ensure that the pins 308 do not fall out during manipulation of the connection system 300. A connector block or sleeve 313 is then connected to the upper end of connector sleeve 302 by a threaded connection, shown at 311. In an alternate embodiment, the block 313 and the cover sleeve 314 can comprise a single piece.

Figure 9:
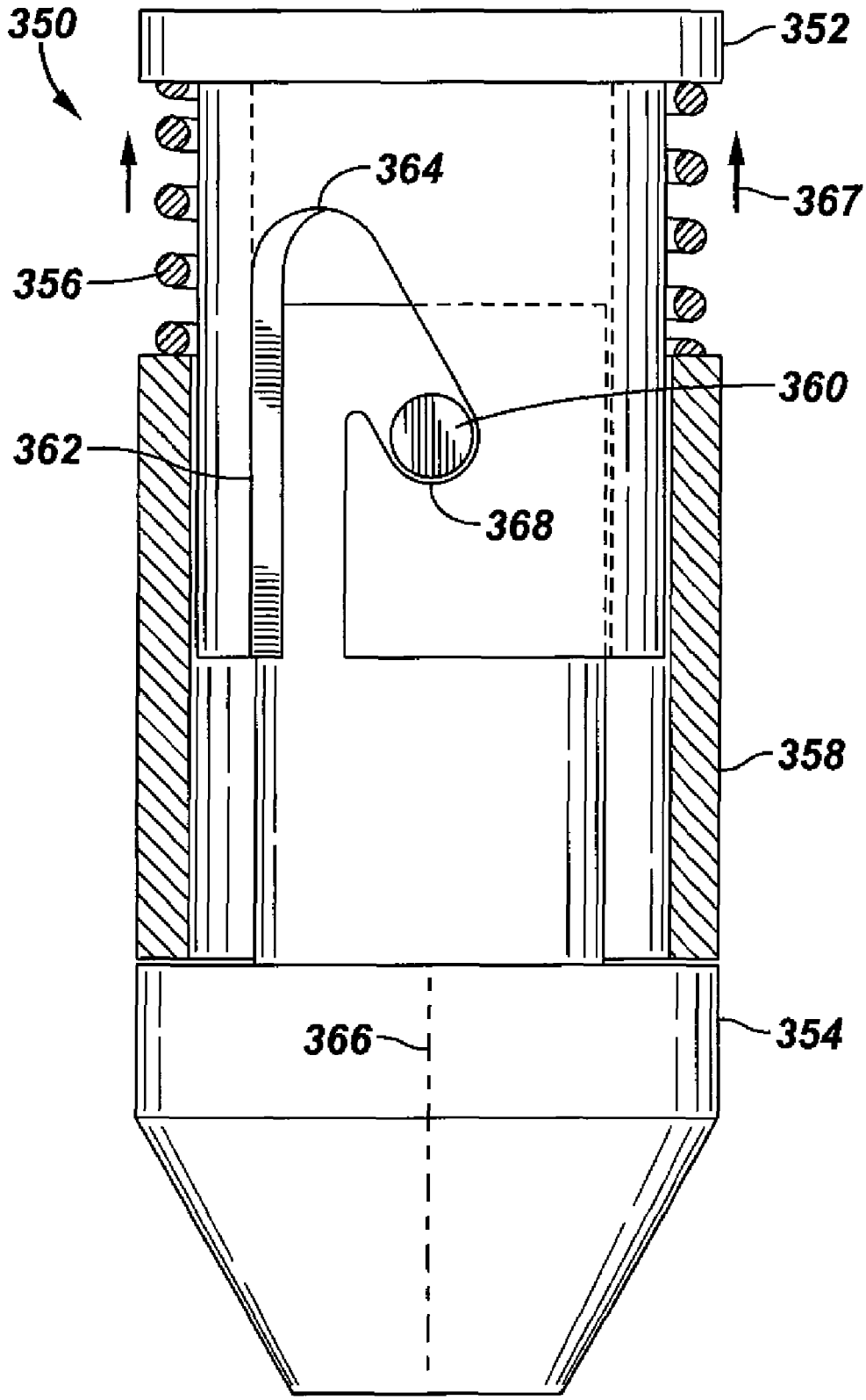
FIG. 9 is a schematic view of a J-slot cable hanger connection for connecting a pulling tool to a cable hanger.

FIG. 9 shows a J-slot connection system 350. A pulling tool 352 is connected to and biased away from the cable hanger 354 by a spring 356 which resides in a spring sleeve 358. A radial pin 360 extends from the cable hanger 354 and resides in a J-slot 362 formed in the tool 352.

To install the pulling tool 352, it is inserted onto the cable hanger 354 against the bias of spring 356 until the pin 360 (aligned in the slot 362) bottoms out on the end 364 of the J-slot 362. The field operator then turns the pulling tool 352 about its longitudinal axis 366 and allows the bias of spring 356 to push the pulling tool 352 upwards in the direction of arrow 367 until the pin bottoms out at the end 368 of J-slot 362. Engagement between the pin 360 and end 368 of J-slot 362 couples the pulling tool 352 to the cable hanger 354. The pulling tool 352 can be disengaged from the cable hanger 354 by following the above steps in reverse.

Figure 10:
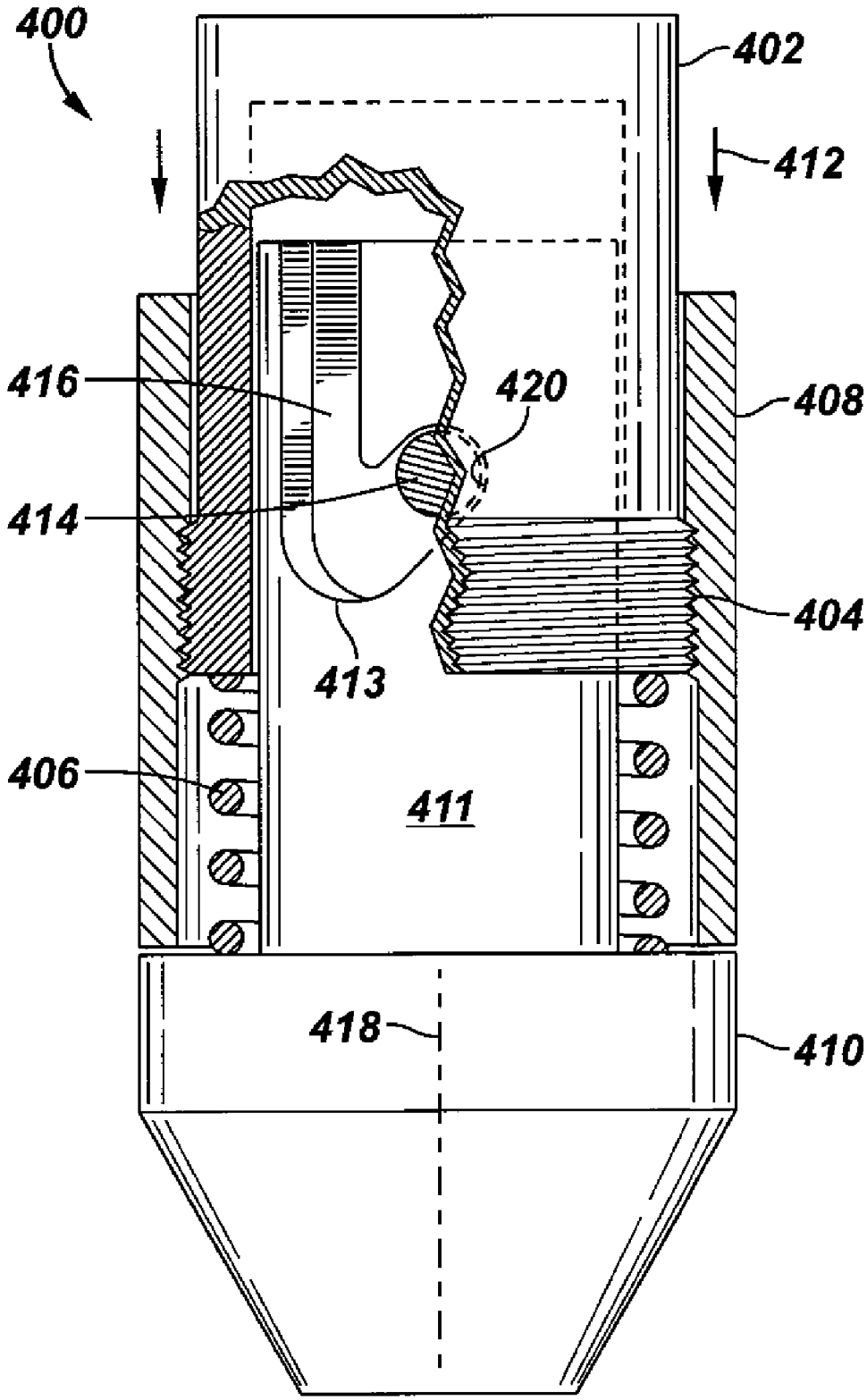
FIG. 10 is another example of a J-slot cable hanger connection for connecting a pulling tool to a cable hanger.

FIG. 10 depicts another example of a J-slot connection system 400. A cable hanger 410 includes an upper end 411 having a J-slot 416 formed therein as shown. A pulling tool 402 includes an inwardly directed radial pin 414 sized and shaped to fit within the J-slot 416. The pulling tool 402 is connected to the cable hanger 410 by aligning the pin 414 with the upper end of the J-slot 416 and moving the pulling tool 402 downward in the direction of arrow 412 along longitudinal axis 418 until the pin 414 reaches the bottom 413 of the J-slot 416. A spring 406 biases against the downward movement of pulling tool 402. Thereafter, the pulling tool 402 is rotated about the axis 418 as the downward force on the tool 402 is released, thus allowing spring 406 to push the pulling tool 402 upward in a direction opposite arrow 412 until the pin 414 registers at the outer end 420 of the J-slot 416. The above steps are taken in reverse to remove the pulling tool 402 from connection with the cable hanger 410. Once connected, a protective sleeve 408 is threaded onto the outer circumference of the pulling tool 402 and connected thereto by threads 404.

What is claimed is:

1. A hanger system supporting a cable-supported dewatering pump in a gas well, the hanger system comprising:

an electrical power cable;

a dewatering pump that is deployed on and supported in a downhole location by the electrical power cable;

a cable hanger bearing the weight of the electrical power cable and the weight of the dewatering pump; and a pulling tool configured to detachably connect to the cable hanger and to support the weight of the cable hanger, electrical power cable and dewatering pump, wherein the pulling tool comprises a bearing sleeve and a locking sleeve, one of the bearing sleeve and locking sleeve being slideable axially relative to the other to selectively lock the bearing sleeve and locking sleeve together and thereby allow the pulling tool to support the cable hanger.

2. A hanger system supporting a cable-supported dewatering pump in a gas well, the hanger system comprising:

a cable;

a dewatering pump that is deployed on and supported in a downhole location by the cable;

a cable hanger bearing the weight of the cable and the weight of the dewatering pump; and a pulling tool configured to detachably connect to the cable hanger and to support the weight of the cable hanger, cable and dewatering pump;

wherein the pulling tool comprises a bearing sleeve and a locking sleeve, one of the bearing sleeve and locking sleeve being slideable axially relative to the other to selectively cause a ball bearing to engage with and bear on surfaces of the cable hanger and on the pulling tool to thereby allow the pulling tool to support the cable hanger.

3. The hanger system of claim 2, wherein the ball bearing resides in an aperture in the locking sleeve and wherein the bearing sleeve is slidable axially downward relative to the locking sleeve against a bias from a first position wherein the ball bearing bears on the surface of the cable hanger and the pulling tool and a second position wherein the ball bearing does not bear on the surfaces of the cable hanger and the pulling tool.

4. The hanger system of claim 3, wherein the bearing sleeve comprises a recess that is sized to accept at least a portion of the ball bearing, wherein the recess is not aligned with the aperture in the first position and wherein the recess is aligned with the aperture in the second position.

5. The hanger system of claim 3, comprising a spring biasing the bearing sleeve away from the locking sleeve.

6. The hanger system of claim 2, wherein the ball bearing resides in an aperture in the bearing sleeve and wherein the locking sleeve is slideable axially upward relative to the bearing sleeve against a bias from a first position wherein the ball bearing bears on the surfaces of the cable hanger and the pulling tool and a second position wherein the ball bearing does not bear on the surfaces of the cable hanger and the pulling tool.

7. The hanger system of claim 6, wherein the bearing sleeve comprises a recess that is sized to accept at least a portion of the ball bearing, wherein the recess is not aligned with the aperture in the first position and wherein the recess is aligned with the aperture in the second position.

8. The hanger system of claim 7, comprising a spring biasing the bearing sleeve away from the locking sleeve.

9. The hanger system of claim 1, wherein the pulling tool comprises a pulling sleeve and a locking sleeve, one of the pulling sleeve and locking sleeve being slideable axially relative to the other against a bias to selectively cause a collet finger to bear on a surface of the cable hanger to thereby connect the pulling tool to the cable hanger.

10. The hanger system of claim 9, wherein the collet finger is on the locking sleeve and wherein the pulling sleeve is axially slideable relative to the locking sleeve from a first position wherein the collet finger is sandwiched between an outer surface of the cable hanger and an inner surface of the pulling sleeve to a second position wherein the collet finger is not sandwiched between the respective surfaces and free to slide out of a recess on the cable hanger.

11. The hanger system of claim 10, wherein the locking sleeve comprises a recess that is aligned with the recess on the cable hanger when the pulling sleeve is in the second position.

12. The hanger system of claim 9, wherein the collet finger is on the pulling sleeve and wherein the locking sleeve is axially slidable relative to the pulling sleeve from a first position wherein the collet finger is sandwiched between an outer surface of the cable hanger and an inner surface of the locking sleeve to a second position wherein the collet finger is not sandwiched between the respective surfaces and free to slide out of a recess on the cable hanger.

13. The hanger system of claim 9, comprising a spring biasing the pulling sleeve and locking sleeve apart.

14. The hanger system of claim 1, wherein the pulling tool has a first part comprising a sleeve having internal threads configured to couple with threads on the cable hanger and a second part comprising a flange surface for engaging with a bearing surface located inside of the sleeve.

15. The hanger system of claim 1, wherein the pulling tool is connected to the hanger by a J-slot connection.

16. The hanger system of claim 15, wherein the pulling tool comprises a cover sleeve configured to slide over the tangential pin connection to prevent fall-out during manipulation of the pulling tool.

17. The hanger system of claim 15, wherein the pulling tool comprises a spring-loaded locking sleeve.

18. The hanger system of claim 15, wherein the pulling tool comprises engagement ridges that engage with engagement channels on the hanger.

19. The hanger system of claim 15, wherein rotation of the pulling tool relative to a locking sleeve facilitates movement of a pin out of the J-slot to disconnect the pulling tool and hanger.

20. The hanger system of claim 1, wherein the pulling tool comprises a truck with a winch.

* * * * *